US009297601B2

(12) United States Patent
White

(10) Patent No.: US 9,297,601 B2
(45) Date of Patent: Mar. 29, 2016

(54) GUN REST SYSTEMS

(71) Applicant: Max White, Arlington, TX (US)

(72) Inventor: Max White, Arlington, TX (US)

( * ) Notice: Subject to any disclaimer, the term of this patent is extended or adjusted under 35 U.S.C. 154(b) by 193 days.

(21) Appl. No.: 14/143,137

(22) Filed: Dec. 30, 2013

(65) Prior Publication Data

US 2014/0182185 A1 Jul. 3, 2014

Related U.S. Application Data

(60) Provisional application No. 61/747,538, filed on Dec. 31, 2012.

(51) Int. Cl.
*F41A 29/00* (2006.01)
*F41A 23/10* (2006.01)
*F41A 23/14* (2006.01)

(52) U.S. Cl.
CPC ..... *F41A 23/10* (2013.01); *F41A 23/14* (2013.01)

(58) Field of Classification Search
USPC ..... 42/94; 89/37.04; 248/165, 176.1
See application file for complete search history.

(56) References Cited

U.S. PATENT DOCUMENTS

| | | | | |
|---|---|---|---|---|
| 5,666,757 | A * | 9/1997 | Helmstadter | F41A 23/04 42/94 |
| 2004/0134113 | A1* | 7/2004 | Deros | F41A 23/16 42/94 |
| 2011/0094140 | A1* | 4/2011 | Letson | F41A 23/16 42/94 |
| 2012/0222344 | A1* | 9/2012 | Werner | F41A 29/00 42/94 |

* cited by examiner

*Primary Examiner* — J. Woodrow Eldred
(74) *Attorney, Agent, or Firm* — Klemchuk LLP; Kirby B. Drake

(57) ABSTRACT

A gun rest system comprises a gun support member comprising a gun support coupling apparatus having a first arm and a second arm, a first leg frame coupled to the first arm, and a second leg frame coupled to the second arm. The gun rest system may be moveable between a disengaged position with the first leg frame and the second leg frame disposed in a substantially parallel orientation and an engaged position with the first leg frame and the second leg frame disposed in a generally angled orientation. The gun rest system may further comprise a base and an adjustable limb coupled between the base and the gun support member.

20 Claims, 8 Drawing Sheets

GUN REST SYSTEMS

CROSS REFERENCE TO RELATED APPLICATION

This application claims priority to and the benefit under 35 U.S.C. §119(e) of U.S. Provisional Patent Application Ser. No. 61/747,538 filed on Dec. 31, 2012 and entitled "Gun Rest Systems," which is incorporated herein by reference in its entirety.

TECHNICAL FIELD

The present disclosure relates generally to gun rest systems and methods, and in particular, to gun rest and shooting sticks systems that are convenient, lightweight and portable.

BACKGROUND

Gun rests are used to support and steady the gun as the user takes aim and shoots, thereby substantially eliminating inadvertent movement and improving the likelihood of delivering an accurate shot. Conventional gun rests, held in place by driving vertical stakes in the ground, are designed and used for firing the gun off the ground with negligent elevation. These devices are typically bulky, complicated pieces of equipment, which require a great deal of time to set up, and as such, the use of gun rests is generally limited to professionals or avid hunters, skilled in using these devices.

Shooting sticks are a type of gun rest used primarily for big game hunting. Conventional shooting sticks consist of two or more rods coupled together with a tie that typically must be repeatedly assembled prior to each use.

SUMMARY

The present disclosure generally provides gun rest systems and methods to stabilize the gun of any user of any level of skill, and thereby substantially improve the accuracy of the shot and decrease the likelihood of inadvertently hitting unintended targets.

In various implementations, a gun rest system may include a gun support member, a base, and an adjustable limb coupled therebetween. The gun support member may include a gun support coupling apparatus having a first arm and a second arm, a first leg frame coupled to the first arm, and a second leg frame coupled to the second arm. The gun rest system may further include an adjustable member coupled between the gun support member and the adjustable limb. The adjustable member may be operable to rotate the gun support member with respect to the adjustable limb along a horizontal axis. The gun rest system may further include a third leg frame coupled to the gun support member. A spacer bar may be disposed between the first leg frame and the second leg frame. The gun rest system may further include a stock support adjustably coupled to and moveable along the adjustable limb.

Implementations may include one or more of the following features. The gun support coupling apparatus may be positioned generally in an open position at rest, with the first arm disposed at an angle from the second arm. The gun support coupling apparatus may be positioned generally in a closed position at rest, with the first arm disposed substantially parallel to the second arm. The gun support coupling apparatus may be formed of vulcanized rubber.

In various implementations, a gun rest system may include a gun support coupling apparatus having a first arm and a second arm, a first leg frame coupled to the first arm, and a second leg frame coupled to the second arm. The gun rest system may be moveable between a disengaged position with the first leg frame and the second leg frame disposed in a substantially parallel orientation and an engaged position with the first leg frame and the second leg frame disposed in a generally angled orientation. A third leg frame may be coupled to the gun support coupling apparatus. The gun rest system may further include a first extender component coupled to and extending the height of the first leg frame, a second extender component coupled to and extending the height of the second leg frame, and a third extender component coupled to and extending the height of the third leg frame. A ledge may be coupled in a generally perpendicular orientation to one of the first leg frame or the second leg frame.

Implementations may include one or more of the following features. The gun support coupling apparatus may be positioned generally in an open position at rest, with the first arm disposed at an angle from the second arm, and the gun support coupling apparatus may be positioned generally in a closed position in tension in the disengaged position. The gun support coupling apparatus may be positioned generally in a closed position at rest, with the first arm disposed substantially parallel to the second arm, and the gun support coupling apparatus may be positioned generally in an open position in tension in the engaged position. The gun support coupling apparatus may be formed of vulcanized rubber.

In various implementations, a gun support coupling apparatus for a gun rest system may include a first arm to couple to a first leg frame of the gun rest system; and a second arm to couple to a second leg frame of the gun rest system.

Implementations may include one or more of the following features. The first arm may be disposed at an angle from the second arm in generally an open position when the gun support coupling apparatus is at rest and in an engaged position of the gun rest system. The first arm may be disposed substantially parallel to the second arm in generally a closed position when the gun support coupling apparatus is in tension and in a disengaged position of the gun rest system. The first arm may be disposed substantially parallel to the second arm in generally a closed position when the gun support coupling apparatus is at rest and in a disengaged position of the gun rest system. The first arm may be disposed at an angle to the second arm in generally an open position when the gun support coupling apparatus is in tension and in an engaged position of the gun rest system.

BRIEF DESCRIPTION OF THE DRAWINGS

For a more complete understanding of the present disclosure and its features, reference is now made to the following description, taken in conjunction with the accompanying drawings, in which.

DETAILED DESCRIPTION

The present disclosure generally provides portable gun rest systems and methods, which can quickly and easily be assembled, and which may be employed to support and stabilize the gun of a user to substantially increase the accuracy of the shot during small and large game hunting.

Figure 1:
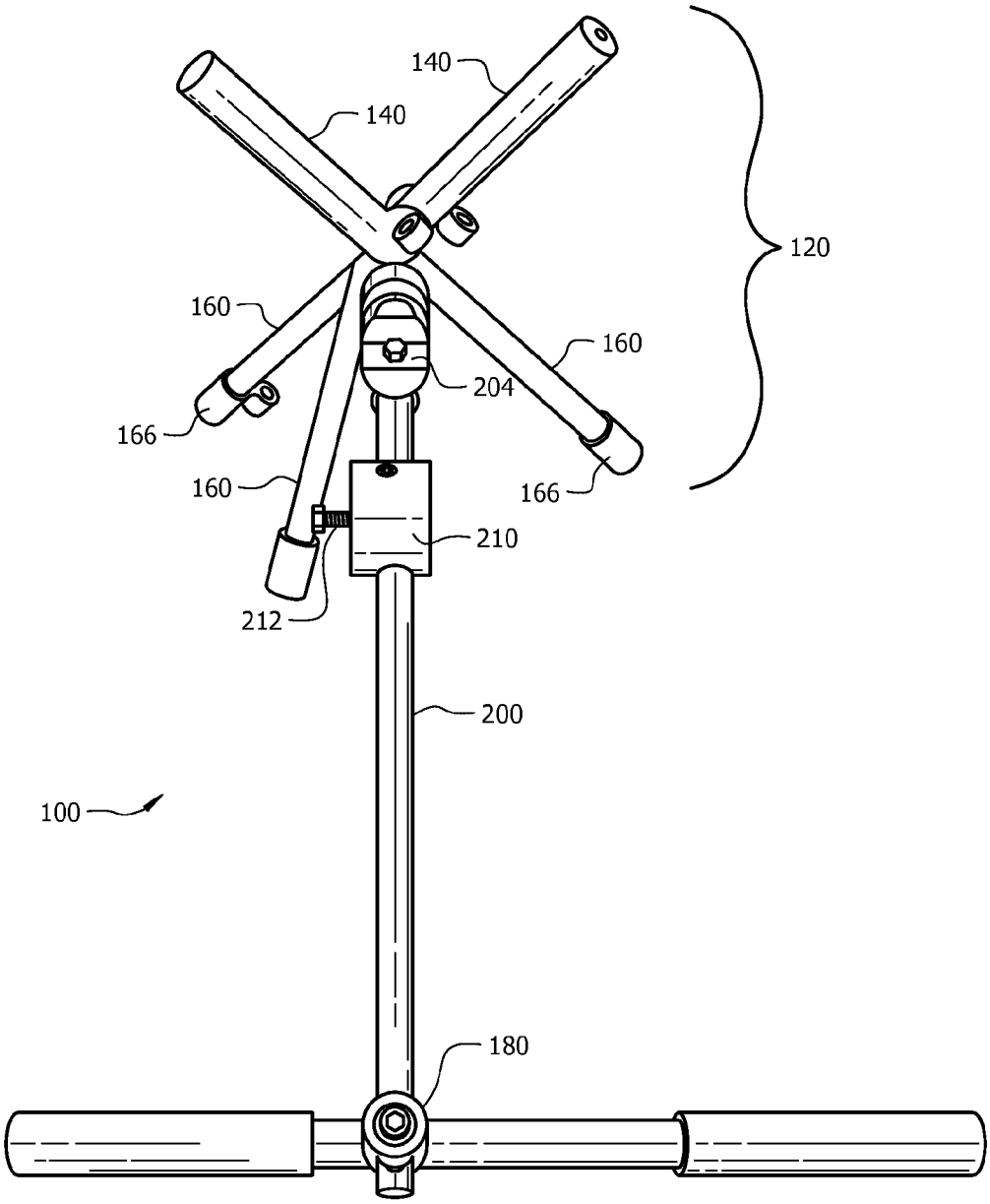
FIG. 1 is a top view of a gun rest in the engaged state arranged in a first representative configuration in accordance with one embodiment of the present disclosure.
Figure 2:
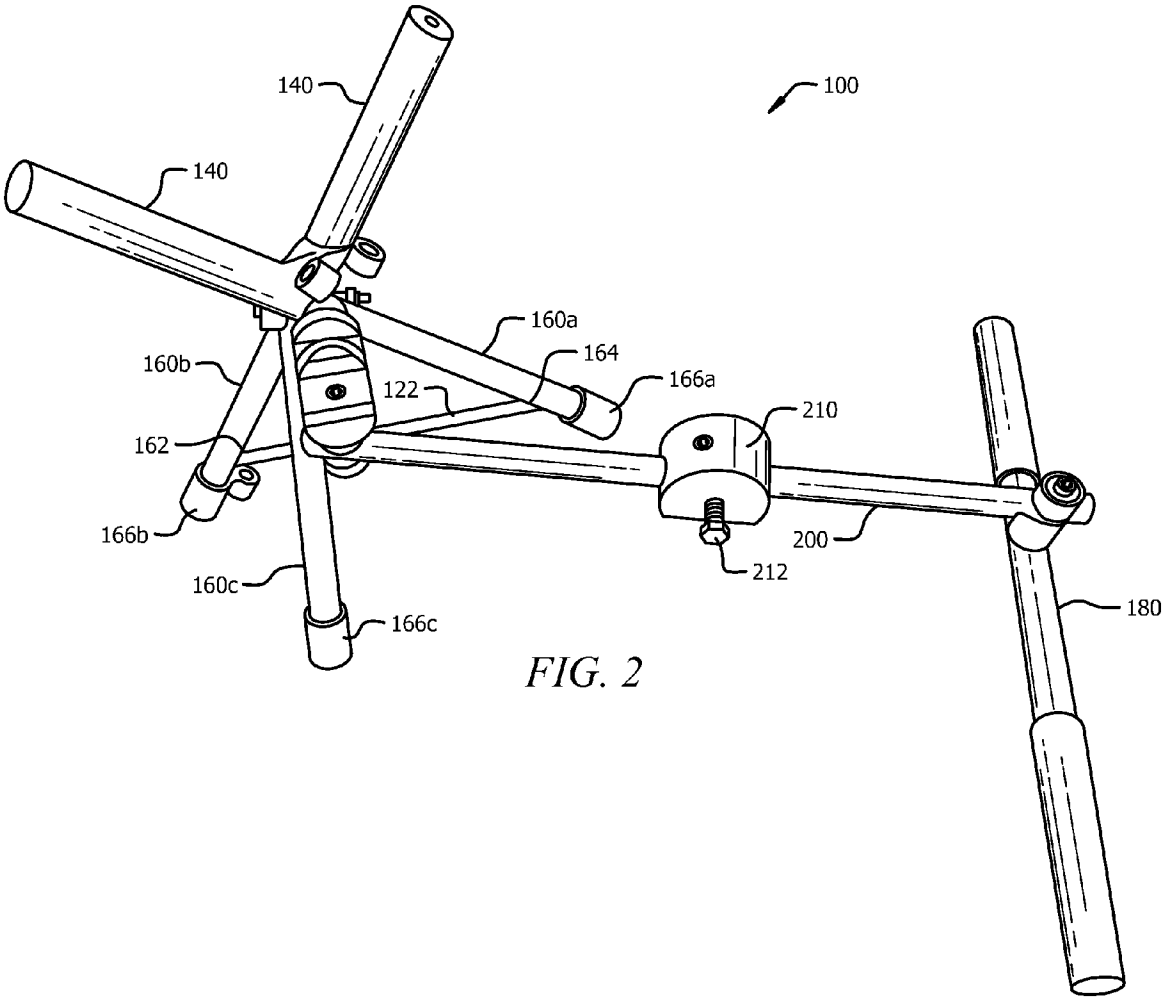
FIG. 2 is a side view of the gun rest of FIG. 1 arranged in a second representative configuration in accordance with one embodiment of the present disclosure.
Figure 3:
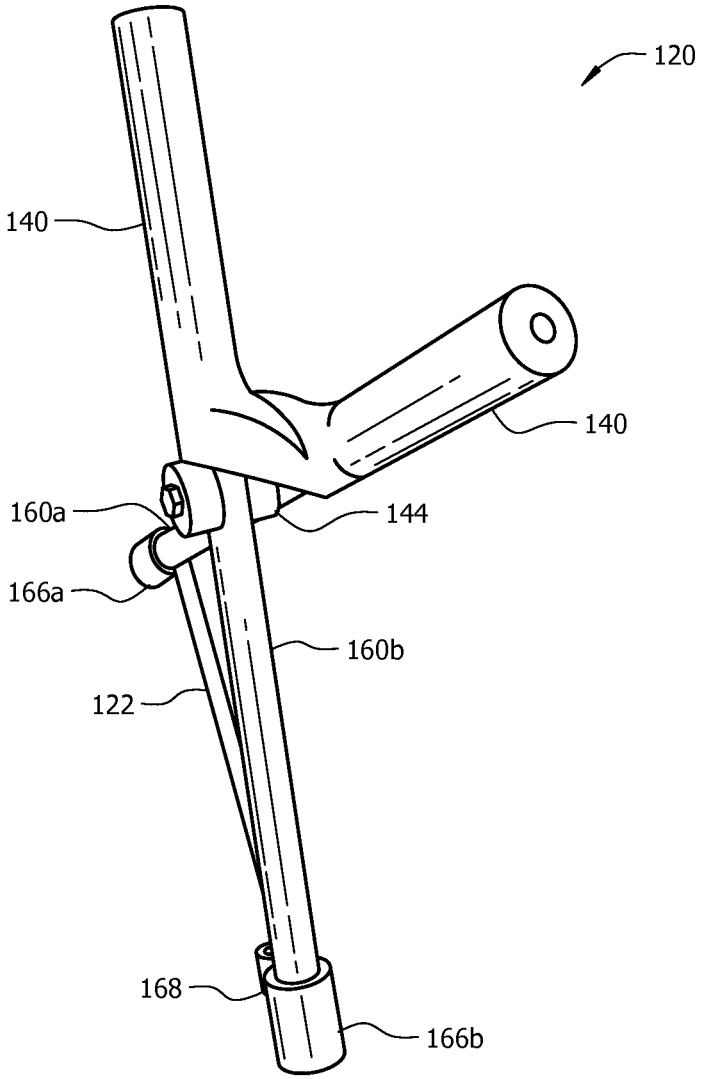
FIG. 3 is a perspective view of a gun support member of the gun rest of FIGS. 1-2 in accordance with one embodiment of the present disclosure.
Figure 4:
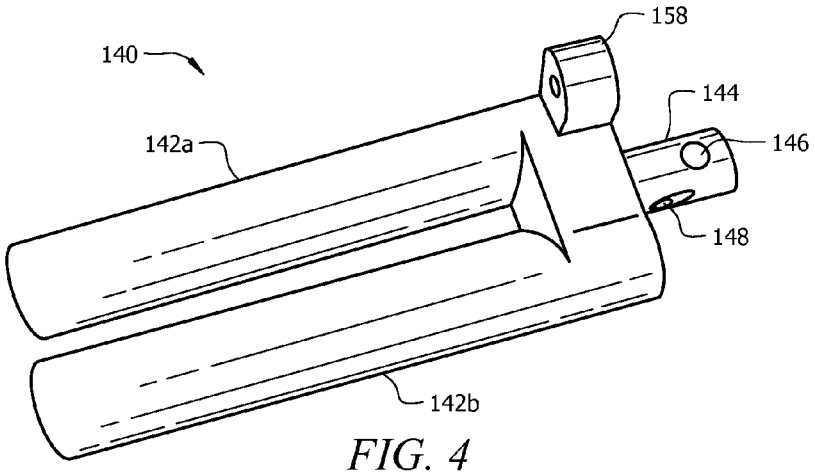
FIG. 4 is a perspective view of a gun support coupling apparatus of the gun support member of FIG. 3 in accordance with one embodiment of the present disclosure.
Figure 5:
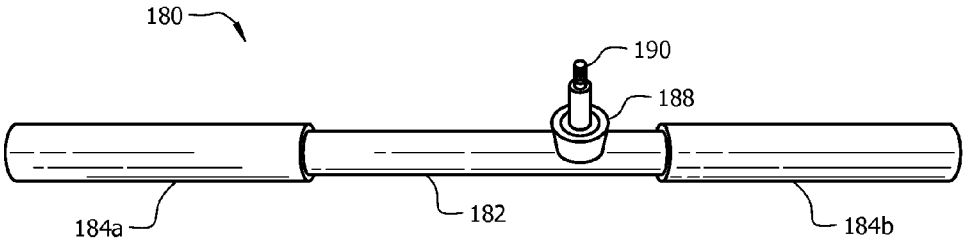
FIG. 5 is a perspective view of a base of the gun rest of FIGS. 1-2 in accordance with one embodiment of the present disclosure.
Figure 6:
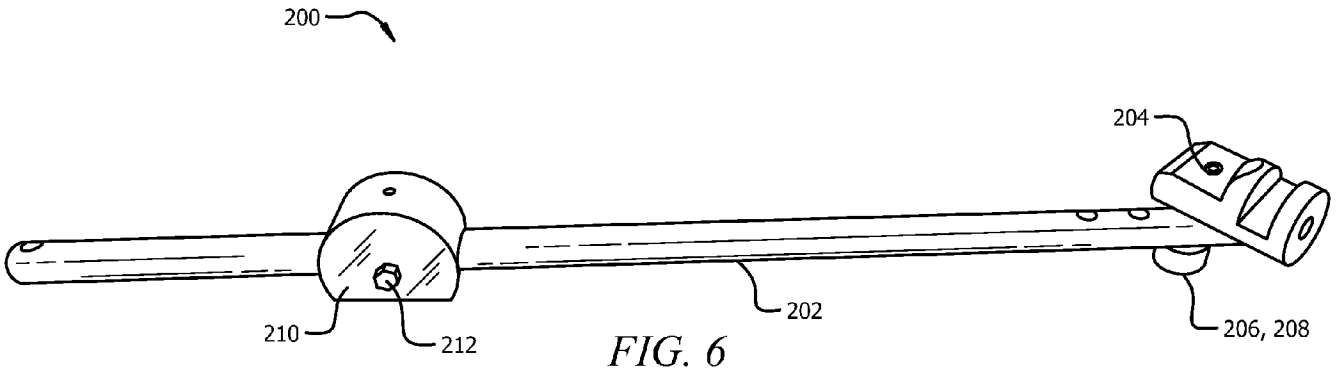
FIG. 6 is a perspective view of an adjustable limb of the gun rest of FIGS. 1-2 in accordance with one embodiment of the present disclosure.
Figure 7:
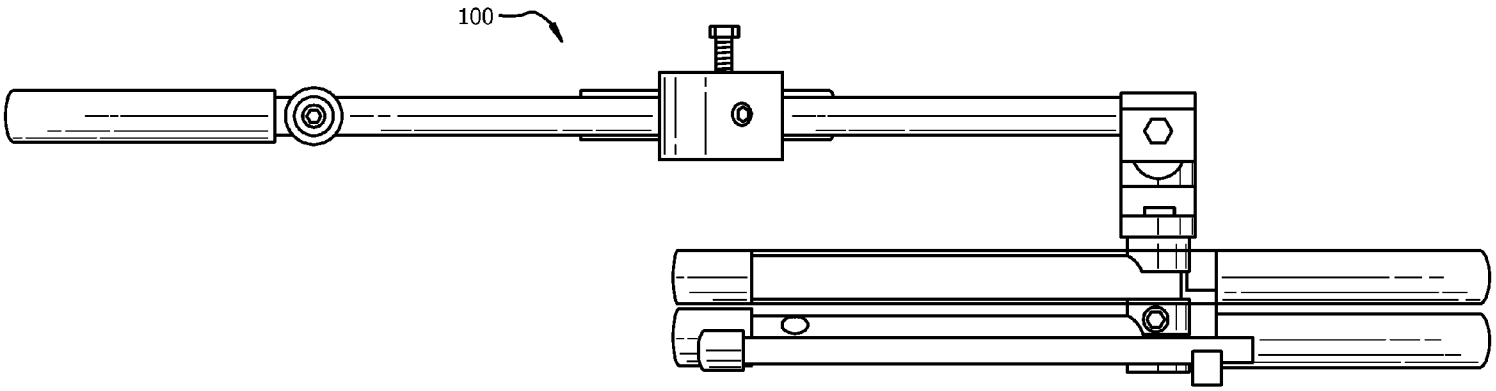
FIG. 7 is an exemplary illustration of the gun rest of FIG. 1-2 in the disengaged state in accordance with one embodiment of the present disclosure.
Figure 8:
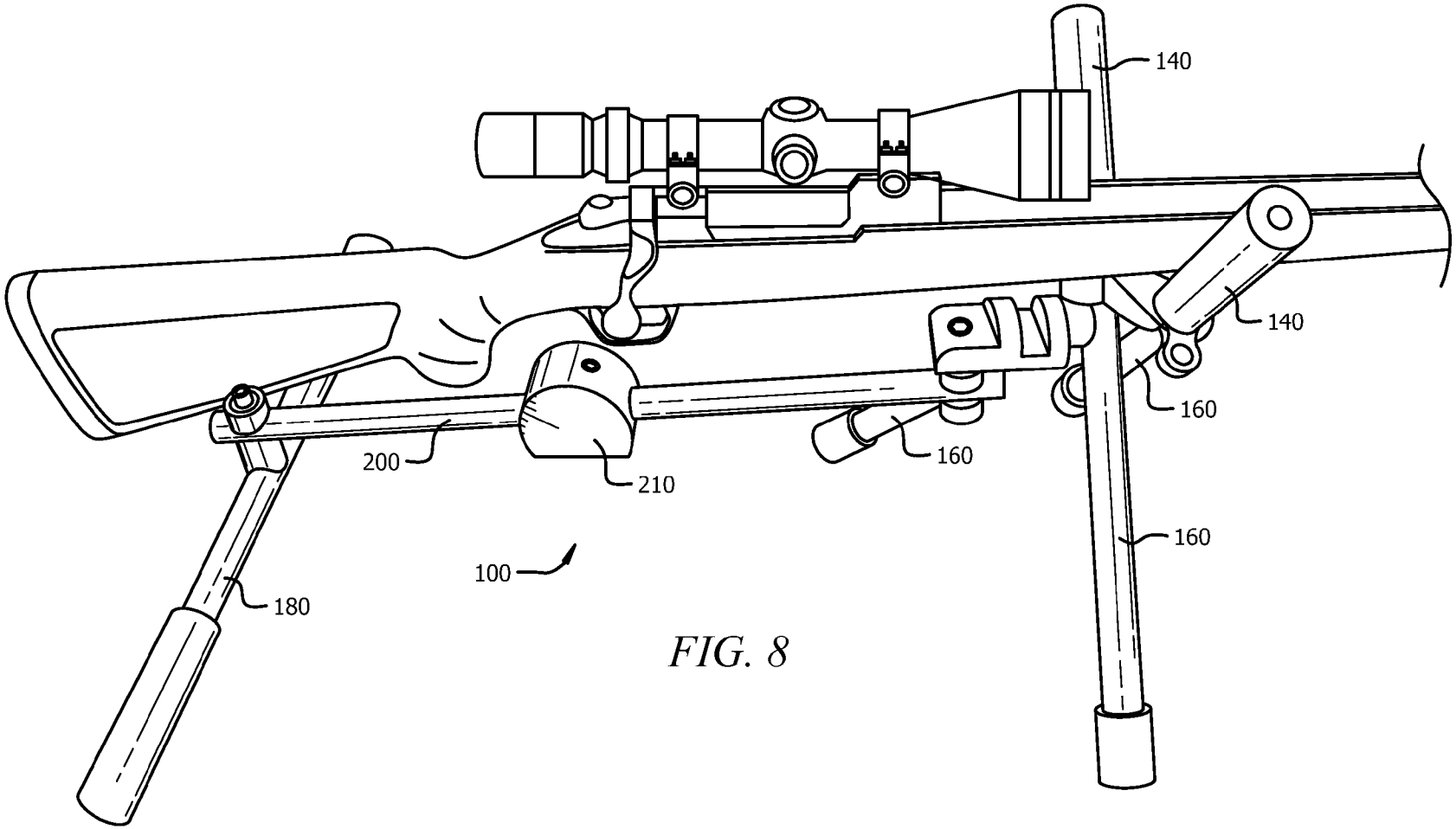
FIG. 8 is an exemplary illustration of the gun rest of FIGS. 1-2 in the engaged state while being used to support a gun in accordance with one embodiment of the present disclosure.

FIGS. 1-8 illustrate a first embodiment of the present disclosure. FIG. 1 illustrates a top view of a gun rest 100 in an engaged state arranged in a first representative configuration. FIG. 2 depicts a side view of the gun rest 100 arranged in a second representative configuration. FIG. 3 illustrates a perspective view of a gun support member 120 of the gun rest 100. FIG. 4 depicts a perspective view of a gun support coupling apparatus 140 of the gun support member 120. FIG. 5 depicts a perspective view of a base 180 of the gun rest 100. FIG. 6 illustrates a perspective view of an adjustable limb 200 of the gun rest 100. FIG. 7 illustrates the gun rest 100 in the disengaged state. FIG. 8 illustrates the gun rest 100 in the engaged state while stabilizing a gun.

Referring now to the gun rest 100 of FIGS. 1-8, it should be understood that gun rest 100 is for illustrative purposes only and that any other suitable system or subsystem may be used in conjunction with, or in lieu of, gun rest 100 according to one embodiment of the present disclosure.

Referring now to FIGS. 1-2, gun rest 100 may comprise a gun support member 120, having a gun support coupling apparatus 140 and leg frames 160. The gun support member 120 may be connected to a base 180 through an adjustable limb 200.

In one embodiment, gun support member 120 may be employed to support and hold a gun while the hunter waits for the desired shot, takes aim, and shoots. Gun support coupling apparatus 140 may be employed to control and maintain the position of leg frames 160 while supporting a user's gun. Base 180 may be employed to provide further stability to gun rest 100 in accordance with one embodiment of the present disclosure. In one embodiment, adjustable limb 200 may be employed to couple the gun support member 120 to the base 180, while also providing a swivel mechanism, such that the user can orient the gun support member 120 at any angle along the horizontal, as desired. Adjustable limb 200 may also provide support to the user's gun as the user takes aim and shoots.

In various embodiments, gun support member 120 may be used in conjunction with or separate from base 180 and adjustable limb 200.

FIG. 3 depicts a perspective view of the gun support member 120 of FIGS. 1-2 that may support the gun while the hunter takes aim and shoots according to one embodiment of the present disclosure. FIG. 4 depicts a gun support coupling apparatus 140 of the gun support member 120 of FIG. 3.

Gun support member 120 may generally include gun support coupling apparatus 140 and leg frames 160*a* and 160*b* (collectively referred to herein as leg frames 160). In one embodiment, leg frames 160*a* and 160*b* may have equivalent lengths.

In an alternative embodiment, gun support member 120 may also include leg frame 160*c* as depicted in FIG. 2. In one embodiment, leg frames 160*a* and 160*b* may have equivalent lengths, while leg frame 160*c* may have a length less than the length of leg frames 160*a* and 160*b*.

Optionally, gun support member 120 may also include a spacer bar 122.

Gun support coupling apparatus 140 may generally include arms 142*a* and 142*b* (collectively referred to herein as arms 142); anchor 144; eyes 146 and 148; and spacer port 158.

Leg frames 160 may generally include spacer ports 162 and 164 within leg frames 160*a* and 160*b*, respectively; and foot caps 166*a*, 166*b*, and 166*c* (collectively referred to herein as foot caps 166) coupled to leg frames 160*a*, 160*b*, and 160*c*, respectively. In one embodiment, foot caps 166 may be employed to provide a smooth, consistent base to stabilize leg frames 160 on top of a surface. Spacer port 168 may be disposed along and affixed to foot cap 166*a*.

In an embodiment, leg frames 160*a* and 160*b* are slidably disposed within arms 142*a* and 142*b*. Leg frame 160*c* may be connected to anchor 144 through eye 146 in any suitable manner, such as, for example using a nut and bolt. Gun support member 120 may be coupled or otherwise connected to adjustable limb 200 through eye 148 of anchor 144 in any suitable manner, such as, for example using a nut and bolt.

In an embodiment, each of the leg frames 160 may extend generally at an angle and generally in opposite directions to form a tripod configuration, as shown in FIG. 2. However, leg frames 160 may be oriented in alternative configurations, including a bipod configuration as shown in FIG. 2, or any other suitable configuration, depending on the number of leg frames 160.

Spacer bar 122 may be employed to maintain the extension of arms 142 when gun rest 100 is in the engaged state. Spacer bar 122 may be inserted between leg frames 160*a* and 160*b* in ports 162 and 164.

FIG. 5 generally illustrates the base 180 of gun rest 100 that may be employed to stabilize gun rest 100 on top of a surface, allowing the hunter to steady the gun while taking aim and shooting according to one embodiment of the present disclosure.

Base 180 may generally include stabilizer bar 182 having stabilizer caps 184*a* and 184*b* (collectively referred to herein as stabilizer caps 184) coupled thereto on either end. In one embodiment, stabilizer caps 184 may be employed to provide a smooth, consistent base to engage the surface.

Base 180 may be centrally pierced to accommodate the adjustable limb 200, which connects the gun support member 120 to the base 180. In one embodiment, base 180 may integrally include a nut 188 or other suitable tool, affixed to the base 180 encompassing the pierced hole, which may be used to fasten base 180 to the adjustable limb 200, and house the bolt 190. In another embodiment, base 180 may be pierced and the hole threaded to firmly fasten the base 180 to the adjustable limb 200 without the use of the nut 188 or other similar tool.

FIG. 6 is an exemplary illustration of the adjustable limb 200 of gun rest 100 that may be employed to secure the gun support member 120 to the base 180, while allowing the user to move the gun rest 100 at any angle along the horizontal axis, in accordance with one embodiment of the present disclosure.

Adjustable limb 200 may generally include limb 202 having adjustable member 204, bolt 206, nut 208, stock support 210 and nut 212 coupled thereto.

In one embodiment, adjustable limb 200 may be connected or otherwise coupled to gun support member 120 through adjustable member 204.

In one embodiment, adjustable member 204 may also be connected or otherwise coupled to limb 202 in any manner that allows gun support member 120 to be rotated along the horizontal axis, such as, for example, using bolt 206 and nut 208, or any other suitable method including having male and female coupling adapters, having a ball and socket attachment, having a brass ring and chain attachment, a clip or pin attachment, or using other suitable coupling materials, or any combination thereof.

In one embodiment, stock support 210 may be connected or otherwise coupled to limb 202 in any manner that allows stock support 210 to be moved along limb 202 as desired to support the stock of a user's gun, such as, for example, using nut 212, or any other suitable method.

FIG. 7 depicts the gun rest 100 in the disengaged state. FIG. 8 illustrates the gun rest 100 in the engaged state while being used to support a gun in accordance with one embodiment of the present disclosure.

Figure 9:
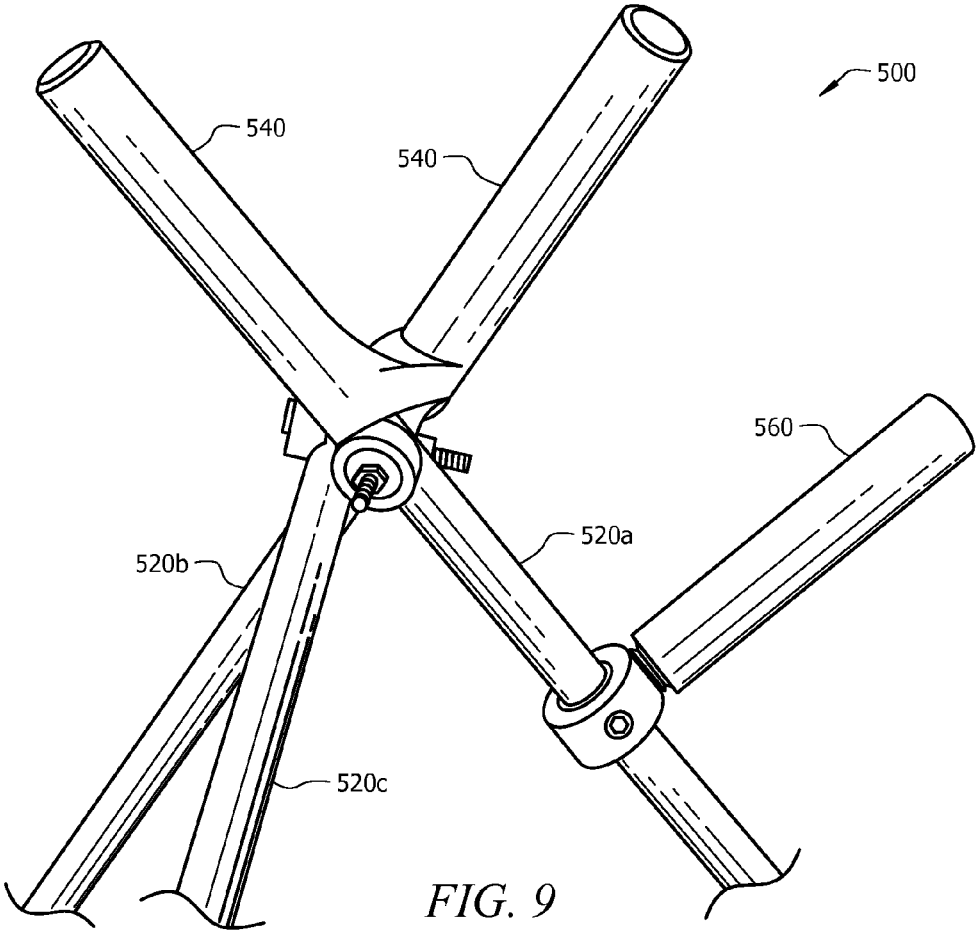
FIG. 9 is an exemplary illustration of a portion of a shooting sticks gun rest system in the engaged state in accordance with one embodiment of the present disclosure.
Figure 10:
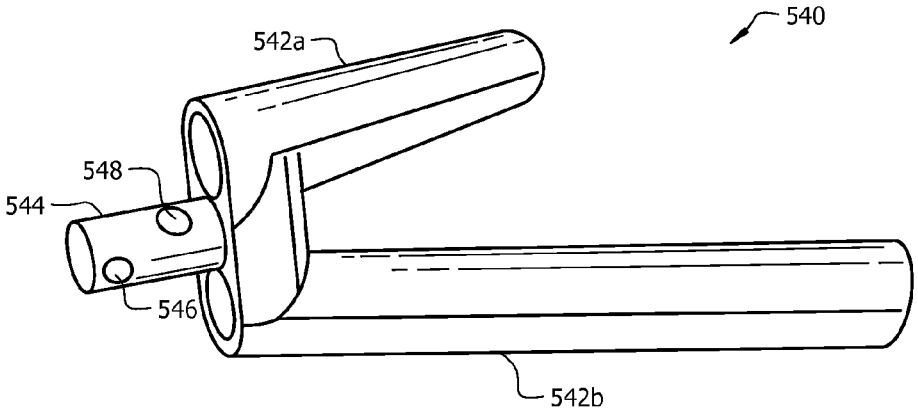
FIG. 10 is a perspective view of a gun support coupling apparatus of the shooting sticks gun rest system of FIG. 9 in accordance with one embodiment of the present disclosure.
Figure 11:
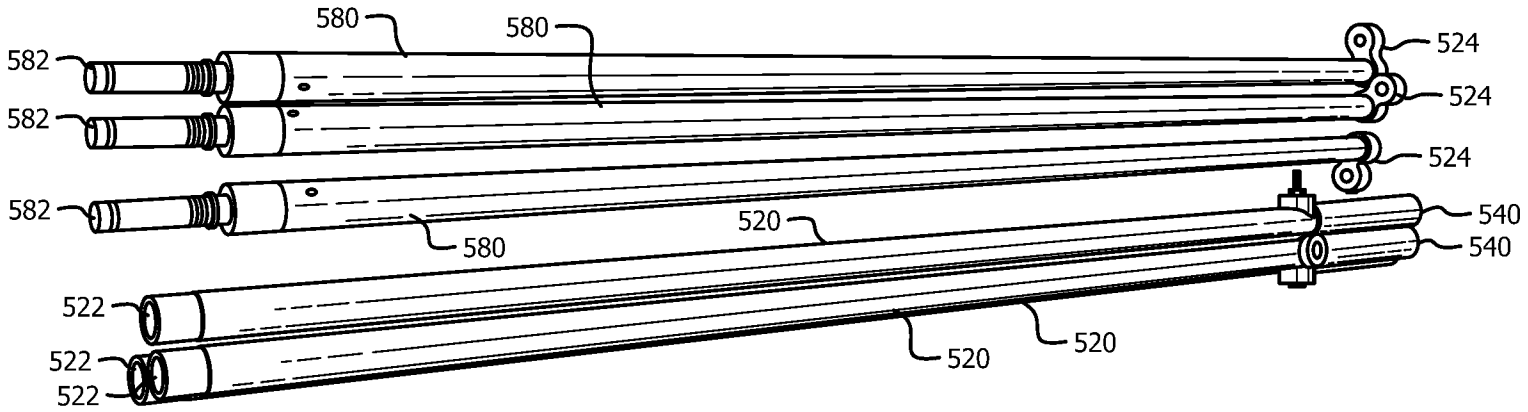
FIG. 11 is an exploded view of the leg frames of the shooting sticks gun rest system of FIG. 9 in the disengaged state in accordance with one embodiment of the present disclosure.

FIGS. 9-11 illustrate a second embodiment of the present disclosure. FIG. 9 illustrates a portion of a shooting sticks gun rest system 500. Users typically employ shooting sticks gun rest systems during big game hunting. FIG. 10 depicts a perspective view of a gun support coupling apparatus 540 of the shooting sticks gun rest system 500. FIG. 11 illustrates the shooting sticks 520, 580 in a disengaged state.

Referring now to the shooting sticks gun rest system 500 of FIGS. 9-11, it should be understood that system 500 is for illustrative purposes only and that any other suitable system or subsystem may be used in conjunction with, or in lieu of, system 500 according to one embodiment of the present disclosure.

In one embodiment, system 500 may generally be similar to gun rest 100 shown in and described in conjunction with FIGS. 1-8 above.

System 500 may generally comprise a plurality of leg frames 520 and a gun support coupling apparatus 540.

In one embodiment, gun support coupling apparatus 540 may be employed to control and maintain the position of leg frames 520, while supporting a user's gun.

In one embodiment, system 500 may include leg frames 520*a*, 520*b* and 520*c*, where leg frames 520*a* and 520*b* are of equivalent length, while leg frame 520*c* may have a length less than the length of leg frames 520*a* and 520*b*.

In alternative embodiments, the number of leg frames 520 may be increased or decreased.

In one embodiment, one or more of leg frames 520 may optionally include ledge 560 coupled thereto, which may provide support and stabilization to the user's arm as the user takes aim and shoots. Ledge 560 may be adjusted to a position along leg frames 520, as desired.

FIG. 10 depicts a perspective view of the gun support coupling apparatus 540 of system 500 that may be employed to support the gun while the hunter takes aim and shoots according to one embodiment of the present disclosure.

Gun support coupling apparatus 540 may generally include arms 542*a* and 542*b* (collectively referred to herein as arms 542); anchor 544; and eyes 546 and 548.

In one embodiment, leg frames 520*a* and 520*b* are slidably disposed within arms 542*a* and 542*b*. Leg frame 520*c* may be connected to anchor 544 through eye 546 in any suitable manner, such as, for example using a nut and bolt.

In an embodiment, when system 500 is in the engaged position, each of the leg frames 520 may extend generally at an angle and generally in opposite directions to form a tripod configuration, as shown in FIG. 9. However, leg frames 520 may be oriented in alternative configurations, including a bipod configuration or any other suitable configuration, depending on the number of leg frames 520.

In one embodiment, ledge 560 may be connected or otherwise coupled to one or more leg members 520 in any manner, such as, for example, using male and female coupling adapters, using a ball and socket attachment, using a brass ring and chain attachment, using a clip or pin attachment, or using other suitable coupling materials, or any combination thereof.

In one embodiment, gun support coupling apparatus 540 may be formed to be disposed in an open configuration at rest, with arms 542*a* and 542*b* positioned away from each other at an angle, as shown in FIG. 10.

In such a configuration, gun support coupling apparatus 540 allows the user to quickly open and set up system 500, when the user detects big game. When system 500 is in the disengaged position, the arms 542 of gun support coupling apparatus 540 are held parallel to each other, causing tension. When system 500 is then engaged, the tension is released, allowing the arms 542 of gun support coupling apparatus 540 to quickly return to its natural open figuration and necessarily causing leg frames 520 to extend outwardly at an angle.

In one embodiment, gun support coupling apparatus 540 may include a spring-loaded coil spring to further assist the user to quickly open and set up system 500 when big game is detected.

In an alternative embodiment, gun support coupling apparatus 540 may be formed to be disposed generally in a closed position at rest, similar to gun support coupling apparatus 140 shown and described in conjunction with FIG. 4 above, with arms 542*a* and 542*b* positioned parallel to each other. In this configuration, the gun support coupling apparatus 140, 540 is opened against tension to the engaged positions shown in FIGS. 1, 2, 3, 8 and 9.

FIG. 11 depicts the shooting sticks gun rest system 500 in the disengaged position according to one embodiment of the present disclosure.

In one embodiment, the length of leg frames 520 may be extended using extender legs 580 to provide a desired height to system 500. Extender legs 580, as shown in FIG. 11, may be connected or otherwise coupled to leg members 520 in any manner, such as, for example, via male coupling adapter 582 interacting with female coupling adapter 522, or any other suitable method including having a ball and socket attachment, having a brass ring and chain attachment, a clip or pin attachment, or using other suitable coupling materials, or any combination thereof.

Leg frames 520 or the combination of leg frames 520 and extender legs 580 may include foot caps 524 coupled thereto. In one embodiment, foot caps 524 may be employed to provide a smooth, consistent base to stabilize leg frames 520 or the combination of leg frames 520 and extender legs 580 on top of a surface.

Any of gun support coupling apparatus 140, foot caps 166, stabilizer caps 184, gun support coupling apparatus 540, foot caps 524, and/or ledge 560 may be made of vulcanized rubber, natural rubber, synthetic rubber, other suitable materials, or any combination thereof.

Any of spacer bar 122, leg frames 160, stabilizer bar 182, limb 202, adjustable member 204, stock support 210, leg frames 520, ledge 560 and/or extender legs 580 may be made of steel, stainless steel, aluminum, brass, bronze, light wall steel tubing, another type of metal, wood, nylon, plastic, polyurethane, polyethylene, polyvinyl chloride (PVC), polytetrafluoroethylene (PTFE), polyester, high-gloss polyester, laminate, synthetic rubber, natural rubber, plastic, plexiglass, polymer, glass, other suitable materials, or any combination thereof.

Any of nut 188, bolt 190, and/or nut 212 may be made of metal, steel, aluminum, brass, bronze, nylon, plastic, wood, polyester, high-gloss polyester, laminate, synthetic rubber, natural rubber, plexiglass, polymer, other suitable materials, or any combination thereof.

In an embodiment, gun support coupling apparatus 140, foot caps 166, stabilizer caps 184, gun support coupling apparatus 540, foot caps 524, ledge 560, spacer bar 122, leg frames 160, stabilizer bar 182, limb 202, adjustable member 204, stock support 210, leg frames 520, ledge 560, extender legs 580, nut 188, bolt 190, and/or nut 212 may include any number of suitable coatings and layers to substantially reduce scratching or injury to the gun, as well as to any surface engaged by the gun rest.

In one embodiment, the coatings and layers applied to gun support coupling apparatus 140, foot caps 166, stabilizer caps 184, gun support coupling apparatus 540, foot caps 524, ledge 560, spacer bar 122, leg frames 160, stabilizer bar 182, limb 202, adjustable member 204, stock support 210, leg frames 520, ledge 560, extender legs 580, nut 188, bolt 190, and/or nut 212 may be made of vulcanized rubber, natural rubber, synthetic rubber, polymer, natural fiber, synthetic fiber, polyester, nylon, cotton, cotton mesh, vinyl, other suitable material, or any combination thereof.

In one embodiment, the gun support coupling apparatus 140, foot caps 166, stabilizer caps 184, gun support coupling apparatus 540, foot caps 524, ledge 560, spacer bar 122, leg frames 160, stabilizer bar 182, limb 202, adjustable member 204, stock support 210, leg frames 520, ledge 560, extender legs 580, nut 188, bolt 190, and/or nut 212, or the coatings and layers applied thereto may be embellished with different colors, patterns, camouflage patterns, wood grain patterns, novelty items, ornamental items, stickers, removable stickers, paints, stencils, chalks, designs, images, other decorative materials, or any combination thereof to enhance or otherwise achieve the desired décor of the surroundings.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A gun rest system comprising:

a gun support member comprising:

a gun support coupling apparatus having a first arm and a second arm;

the first arm provided to receive a first leg frame, the first leg frame slidably disposed within the first arm; and the second arm provided to receive a second leg frame, the second leg frame slidably disposed within the second arm;

a base; and an adjustable limb coupled between the gun support member and the base.

2. The gun rest system of claim 1, wherein the gun support coupling apparatus is positioned in an open configuration, with the first arm disposed at an angle away from the second arm.

3. The gun rest system of claim 1, wherein the gun support coupling apparatus is positioned in a closed position, with the first arm disposed parallel to the second arm in the closed position.

4. The gun rest system of claim 1, further comprising:

an adjustable member coupled between the gun support member and the adjustable limb, wherein the adjustable member is operable to rotate the gun support member with respect to the adjustable limb along a horizontal axis, the horizontal axis provided perpendicular to the length of the adjustable limb.

5. The gun rest system of claim 1, further comprising a third leg frame coupled to the gun support member.

6. The gun rest system of claim 1, further comprising a spacer bar disposed between the first leg frame and the second leg frame.

7. The gun rest system of claim 1, wherein at least a portion of the gun support coupling apparatus is made of vulcanized rubber.

8. The gun rest system of claim 1, further comprising:

a stock support adjustably coupled to the adjustable limb;

wherein the stock support is moveable along the length of the adjustable limb; and wherein the stock support is provided to support the stock of a gun.

9. A gun rest system comprising:

a gun support coupling apparatus having a first arm and a second arm;

the first arm provided to receive a first leg frame, the first leg frame slidably disposed within the first arm; and the second arm provided to receive a second leg frame, the second leg frame slidably disposed within the second arm;

wherein the gun rest system is moveable between a disengaged position with the first leg frame and the second leg frame disposed in a parallel orientation and an engaged position with the first leg frame and the second leg frame disposed in an angled orientation.

10. The gun rest system of claim 9, wherein the gun support coupling apparatus is positioned in an open configuration, with the first arm disposed at an angle away from the second arm; and wherein the gun support coupling apparatus is positioned in a closed position in in the disengaged position.

11. The gun rest system of claim 9, wherein the gun support coupling apparatus is positioned in a closed position, with the first arm disposed parallel to the second arm in the closed position; and wherein the gun support coupling apparatus is positioned in the open configuration in the engaged position.

12. The gun rest system of claim 9, further comprising a third leg frame coupled to the gun support coupling apparatus.

13. The gun rest system of claim 12, further comprising:

a first extender component coupled to and extending the height of the first leg frame;

a second extender component coupled to and extending the height of the second leg frame; and a third extender component coupled to and extending the height of the third leg frame.

14. The gun rest system of claim 9, further comprising:

a ledge coupled in a perpendicular orientation to one of the first leg frame or the second leg frame, wherein the ledge is configured to support and stabilize an arm of a user as the user aims and shoots a gun.

15. The gun rest system of claim 9, wherein at least a portion of the gun support coupling apparatus is made of vulcanized rubber.

16. A gun support coupling apparatus for a gun rest system, the gun rest system having a first leg frame and a second leg frame, the gun support coupling apparatus comprising:

a first arm arranged to receive the first leg frame, the first leg frame slidably disposed within the first arm;

a second arm arranged to receive the second leg frame, the second leg frame slidably disposed within the second arm; and at least one vulcanized rubber layer, wherein the gun support coupling apparatus is made of the at least one vulcanized rubber layer.

17. The gun support coupling apparatus of claim 16, wherein the first arm is disposed at an angle away from the second arm in an open configuration when the gun support coupling apparatus is in an engaged position of the gun rest system.

18. The gun support coupling apparatus of claim 17, wherein the first arm is disposed parallel to the second arm in a closed position when the gun support coupling apparatus is in a disengaged position of the gun rest system.

19. The gun support coupling apparatus of claim 16, wherein the first arm is disposed parallel to the second arm in a closed position when the gun support coupling apparatus is in a disengaged position of the gun rest system.

20. The gun support coupling apparatus of claim 19, wherein the first arm is disposed at an angle away from the second arm in an open configuration when the gun support coupling apparatus is in an engaged position of the gun rest system.

* * * * *